US006488248B1

(12) United States Patent
Watt et al.

(10) Patent No.: US 6,488,248 B1
(45) Date of Patent: Dec. 3, 2002

(54) KEYBOARD MECHANISM TRACKING SYSTEM

(75) Inventors: Richard L. Watt, Bemus Point, NY (US); Matthew J. Ransil, Stevens, PA (US)

(73) Assignee: Weber Knapp Company, Jamestown, NY (US)

( * ) Notice: Subject to any disclaimer, the term of this patent is extended or adjusted under 35 U.S.C. 154(b) by 0 days.

(21) Appl. No.: 09/700,231

(22) PCT Filed: May 9, 2000

(86) PCT No.: PCT/US00/12637

§ 371 (c)(1),
(2), (4) Date: Nov. 13, 2000

(87) PCT Pub. No.: WO01/84987

PCT Pub. Date: Nov. 15, 2001

(51) Int. Cl.[7] ..... B68G 5/00; B43L 15/00; F16M 11/20; F16M 13/00; A47F 5/00

(52) U.S. Cl. ..... 248/279.1; 248/918; 108/138; 108/140

(58) Field of Search ..... 248/281.11, 284.1, 248/188.1, 118, 118.3, 286.1, 276.1, 918, 279.1; 108/140, 143, 138; 312/282, 208.1, 223.3, 334.25, 334.26

(56) References Cited

U.S. PATENT DOCUMENTS 4,208,079 A * 6/1980 Prado ..... 312/202
4,616,798 A * 10/1986 Smeenge ..... 248/281.1
4,706,919 A * 11/1987 Soberalksi ..... 248/281.1
5,302,015 A 4/1994 Du Vall ..... 312/282
5,711,517 A * 1/1998 Kelly ..... 271/14.01
5,878,674 A 3/1999 Allan ..... 108/93
5,924,664 A * 7/1999 Mileos ..... 248/281.11
5,947,035 A * 9/1999 Chang ..... 108/94
6,027,090 A * 2/2000 Liu ..... 248/281.11
6,270,047 B1 * 8/2001 Hudson ..... 248/286.1

* cited by examiner

*Primary Examiner*—Ramon O. Ramirez
*Assistant Examiner*—Amy J. Sterling
(74) *Attorney, Agent, or Firm*—Simpson & Simpson, PLLC

(57) ABSTRACT

A keyboard support mechanism is disclosed as including an improved arrangement for supporting a trolley of such mechanism for movement relative to a guide track by which the mechanism is mounted on a work station. The trolley is fitted with two pairs of rollers arranged to roll lengthwise of the guide track within a pair of edge mounted mounting channels thereof and a follower; and the guide track is fitted with guide member having a guide channel adapted to slidably receive the follower while preventing movement of the trolley transversely of the guide channel. The guide channel extends rearwardly of a front end of the guide track, whereby to cooperate with the follower to stabilize an auxiliary surface on which a keyboard is supported against undesired transverse or sidewise movement when in its extended use position, while permitting loose fitting of the trolley within the guide track during a substantial portion of its movement of the auxiliary surface to an from its rearward storage position.

11 Claims, 2 Drawing Sheets

KEYBOARD MECHANISM TRACKING SYSTEM

BACKGROUND OF THE INVENTION

Keyboard support mechanisms of the type adapted for supporting a keyboard for user induced movement relative to a work station having a front marginal edge arranged to face a user and a downwardly facing mounting surface for mounting such mechanism typically including guide track adapted for attachment to the mounting surface to extend rearwardly of such front marginal edge, a trolley supported by the guide track for movement between a forwardly extended keyboard use position and rearwardly disposed keyboard storage or retracted position; an auxiliary surface or a keyboard support; and a linkage for mounting the auxiliary surface on the trolley for relative vertical movement.

In one of mechanism, a trolley is fitted with plastic guides arranged to be slidably received within facing mounting channels extending lengthwise of marginal edges of a guide track. This construction is suitable for lightweight mechanisms where friction between the guides and mounting channels does not adversely affect sliding movement of the trolley between use and storage positions.

In another type of mechanism adapted for use with relatively heavy mechanisms, wherein excessive frictional forces would be encountered with the use of sliding plastic guides, a trolley is fitted with pairs of rollers arranged to roll lengthwise within the mounting channels. While rolling action tends to substantially reduce a user's effort required to move the trolley, a drawback of presently known mechanisms is that the auxiliary surface is rendered unstable or sidewise movable when placed in its keyboard use position, due to required clearances between the transverse outwardly facing surfaces of the rollers and the transverse inwardly facing surfaces of the mounting channels necessary to allow for free rolling movement of the trolley without binding engagement with the guide track. An unstable auxiliary surface tends to interfere with normal use of a keyboard and/or mouse supported thereon.

SUMMARY OF THE INVENTION

The present invention is directed to an improved keyboard support mechanism, and more particularly, to an improved arrangement for supporting a trolley of such mechanism for movement relative to a guide track by which the mechanism is mounted on a work station or work surface.

In accordance with the present invention, a trolley is fitted with two pairs of rollers arranged to roll lengthwise of a guide track within a pair of edge mounted mounting channels thereof and a follower member; and the guide track is fitted with a guide member having a guide channel adapted to slidably receive the follower member of the trolley. The guide channel extends only part way rearwardly from a front end of the guide track, whereby to cooperate with the follower member of the trolley to stabilize or constrain an auxiliary surface on which a keyboard is supported against undesired transverse or sidewise movement when in its extended keyboard use position, while permitting loose fitting of the trolley within the guide track during a substantial portion of the extent of movement of the auxiliary surface to and from its storage or retracted position.

BRIEF DESCRIPTION OF THE DRAWINGS

The nature and mode of operation of the present invention will now be more fully described in the following detailed description taken with the accompanying drawings wherein.

DETAILED DESCRIPTION

Figures 1, 3:
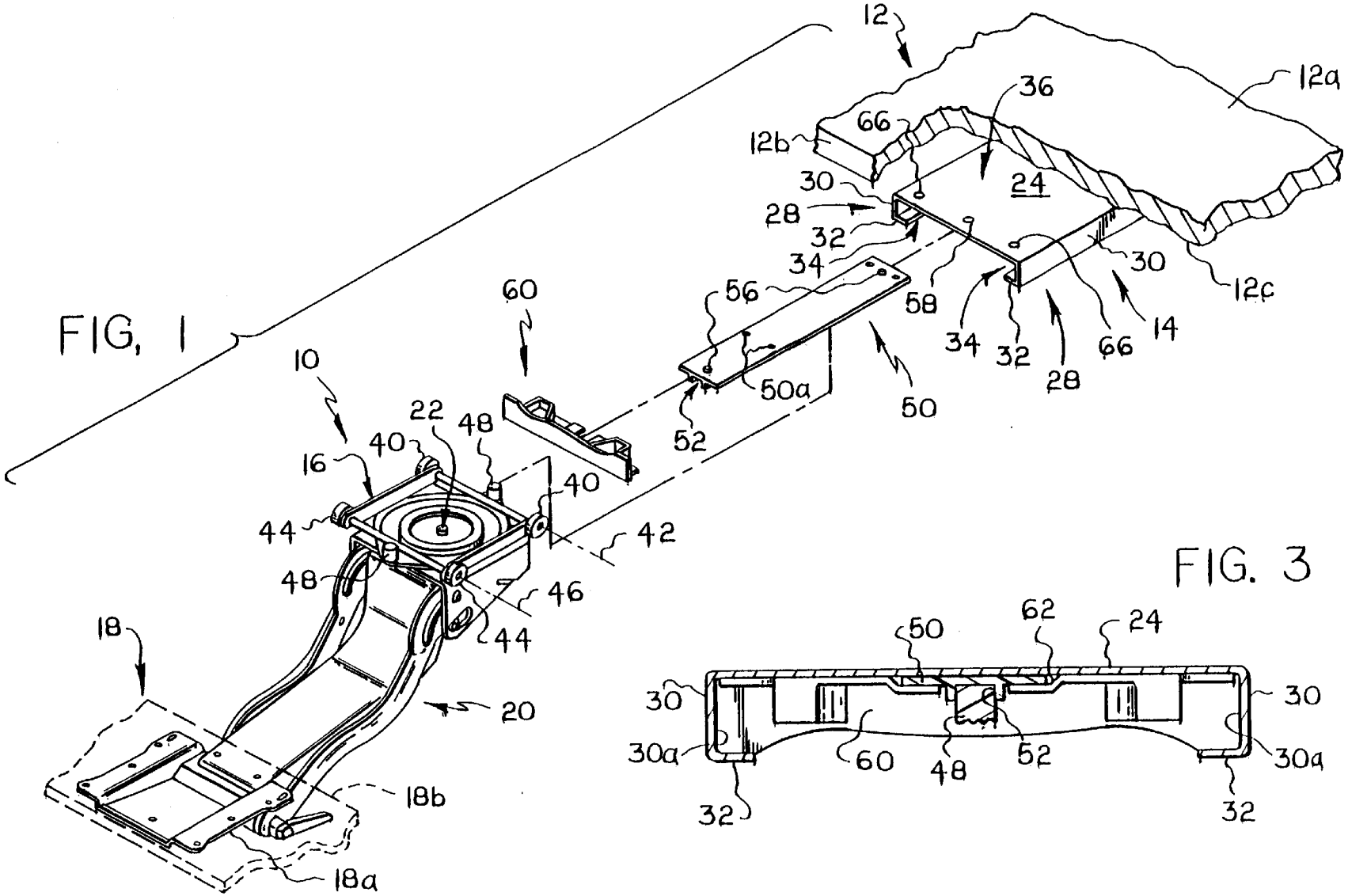
FIG. 1 is an exploded, prospective view of a mechanism for supporting a keyboard or other art device for movement relative to a work station.
FIG. 3 is a sectional view taken generally along the line 3—3 in FIG. 2.

Reference is first made to FIG. 1, wherein a mechanism for supporting a conventional keyboard, not shown, is generally designated as 10 and shown in association with a work station 12 having a tabletop or primary work surface 12*a* formed with a front marginal edge 12*b* arranged to face a user and a lower mounting surface 12*c*.

Mechanism 10 is shown as being conventional from the standpoint that it generally includes a guide track 14 adapted to be fixed to mounting surface 12*c*; a trolley 16 adapted to be supported by the guide track for movement lengthwise thereof; a keyboard support 18, such as may be defined by a bracket 18*a* and an auxiliary or keyboard supporting surface 18*b*; and a linkage mechanism 20 for mounting the keyboard support for vertical swinging movement relative to the trolley. Linkage mechanism 20 may be supported for horizontal swinging movement relative to trolley 16 by a vertical pivot assembly 22, and bracket 18*a* and auxiliary surface 18*b* may be replaced by a device, not shown, serving to clamp a keyboard directly to linkage mechanism 20.

Figure 2:
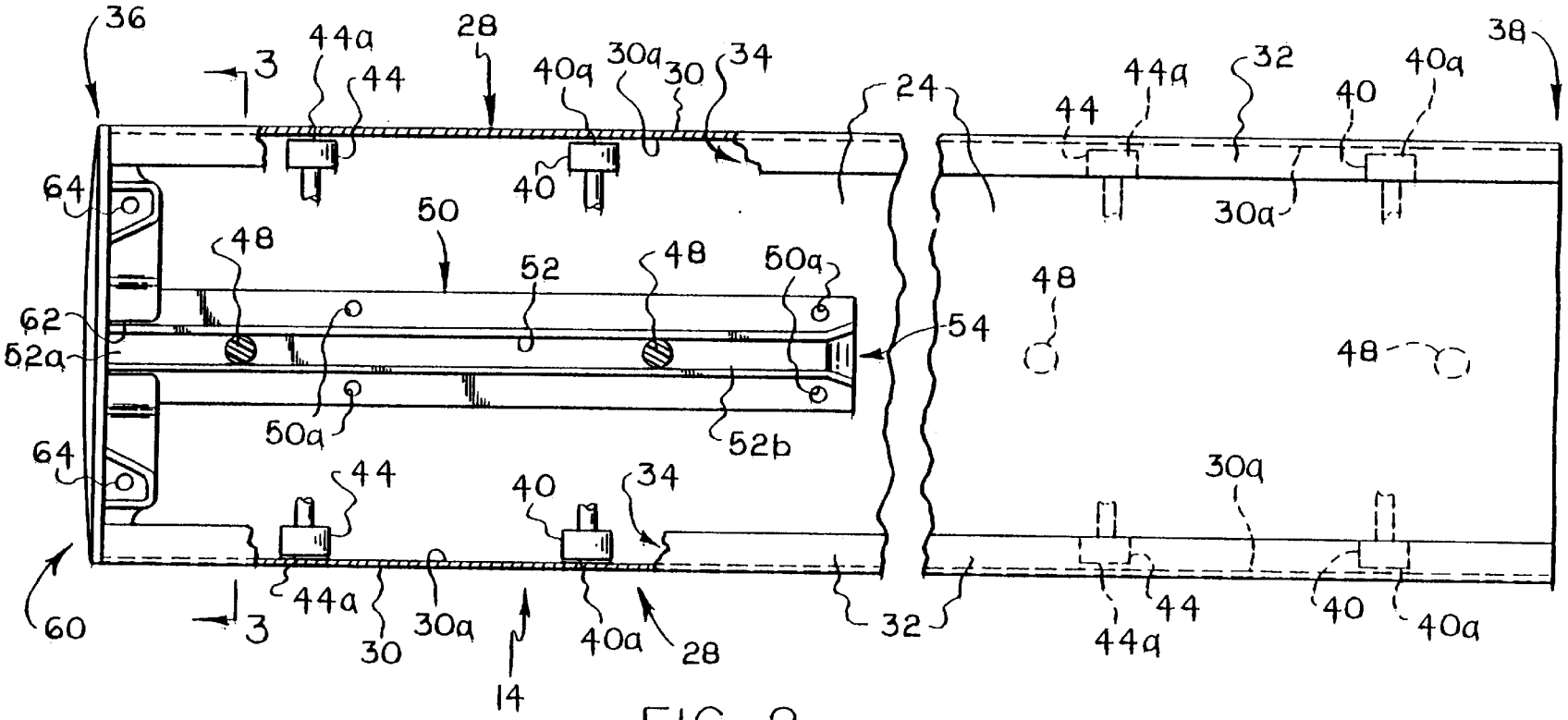
FIG. 2 is a bottom plan view of a guide track and guide member of the present invention in association with follower members.

Guide track 14 is shown in the drawings as being conventional in that it includes a mounting plate portion 24 adapted to be suitably fixed to mounting surface 12*c*, such as by threaded fasteners, not shown, passing through mounting openings, also not shown; and a pair of edge portions 28 and 28, which extend lengthwise of the guide track and are defined by a pair of parallel connecting flange portions 30 and 30 depending from the mounting plate portion and coplanar support flange portions 32 and 32 arranged in a parallel facing relationship to the mounting plate portion. Mounting plate portion 24 is intended to cooperate with support flange portions 32 and 32 to define a pair of facing mounting channels 34 and 34, which extend between the front end 36 and rear end 38 of guide track 14, as best shown in FIG. 2. As will be understood from viewing FIG. 1, guide track 14 would normally be arranged in an essentially right angular relationship to front marginal edge 12*b* with its front end 36 arranged to lie relatively adjacent to such front marginal edge.

In accordance with the present invention, trolley 16 is provided with a first pair of support rollers 40 and 40 mounted for rotation about a horizontally extending first axis 42, and a second pair of support rollers 44 and 44 mounted for rotation about a horizontally extending second axis 46 disposed parallel to the first axis. As will be apparent from viewing FIG. 2, support rollers 40 and 40 and support rollers 44 and 44 are intended to be disposed one in each of mounting channels 34 and 34 with their oppositely facing or relatively outer surfaces 40*a* and 40*a*, 44*a* and 44*a* spaced from facing surfaces 30*a* and 30*a* of connecting flange portions 30 and 30 sufficiently to loosely receive the support rollers therebetween and permit the support rollers to freely move lengthwise of guide track 14 within such mounting channels between the forward keyboard use and a rearward keyboard storage position, shown generally in full and broken line in FIG. 2.

Trolley 16 is further provided with an elongated follower means preferably defined by a pair of follower members in the form of cylindrical pins 48 and 48 arranged to upstand from the trolley in a direction towards mounting plate portion 24. Pins 48 and 48 are disposed one intermediate and equidistant from first support rollers 40 and 40 and second support rollers 44 and 44.

In accordance with the invention, mechanism 10 further includes a guide member 50, which is adapted to be fixed to mounting plate portion 24. Guide member 50 defines a guide channel 52, which is intended to be disposed essentially parallel to and equidistant from facing surfaces 30*a* and 30*a* of connecting flange portions 30 and 30, and has a front end 52*a* disposed immediately adjacent front end 36 of guide track 14 and a rear end 52*b*. Guide channel 52 is transversely sized to slidably receive follower pins 48 and 48, so as to constrain relative transverse movement thereof and maintain oppositely facing surfaces 40*a* and 40*a* and 44*a* and 44*a* relatively uniformly spaced from surfaces 30*a* and 30*a* of the connecting flange portions. Preferably, guide member additionally defines a converging inlet 54 communicating with the rear end of guide channel 52 and adapted to smoothly guide or channel pins 48 and 48 into the rear end of the guide channel incident to forward movement of trolley 16. The length of the guide channel preferably exceeds the length of the follower means, i.e. the spacing between oppositely facing surfaces of pins 48 and 48, but is no more than twice such length, as best shown in FIG. 2. For purposes of illustration, in one present commercial form of the invention, the length of the guide channel is 9.25 inches, the length of guide track is 16.25 inches, and the length of the follower means is about 5.37 inches. It is also preferable to automatically locate guide member 50 centrally of mounting plate portion 24 by providing the guide member with locating studs 56 adapted to be slidably inserted upwardly within locating openings formed in the mounting plate portion, only one of such locating openings being shown in FIG. 1 at 58. Guide member 50 may be suitably fixed to mounting plate portion 24, such as by threaded fasteners, not shown, inserted through guide member mounting openings 50*a* and aligned mounting openings, not shown, provided in mounting plate portion 24.

It is also preferable to provide a cover plate 60 for blocking the front end 52*a* of guide channel 52 in order to prevent movement of follower pins 48 and 48 outwardly therethrough, as well as for visually closing the front end of the guide track 14, both sidewise between connection flange portions 30 and 30 and vertically between mounting plate portion 24 and support flange portions 32 and 32. As best shown in FIGS. 2 and 3, cover plate 60 has a midportion provided with a recess 62 for receiving the front end of guide member 50 in order to automatically locate the cover plate centrally, sidewise relative to connecting flange portions 30 and 30, where its mounting openings 64 and 64 are aligned with mounting openings 66 and 66 formed in mounting plate portion for receipt of suitable fasteners, not shown.

In operation, guide channel 52 and follower pins 48 and 48 cooperated to constrain transverse or sidewise movement of trolley 16 relative to guide track 14 incident to placement of keyboard support 18 in or immediately adjacent its keyboard use position in order to stabilize such support during use of a keyboard and/or mouse supported thereon. After movement of follower pins 48 and 48 through the open rear end of guide channel 52, trolley 16 is freed from transverse or lateral constraint afforded by guide member 50 and it is loosely revised by trackway 14 for free movement towards and away from the retracted or storage position of the keyboard.

What is claimed is:

1. In a mechanism for supporting a keyboard for movement relative to a work station having a front marginal edge and a downwardly facing mounting surface, and including an elongated guide track adapted to be fixed to said mounting surface to extend essentially normal to said marginal edge with a front end of said guide track disposed adjacent said marginal edge; said guide track having a mounting plate portion adapted to be fixed to said mounting surface and a pair of lengthwise extending edge portions including parallel connecting flange portions depending from said mounting plate portion and coplanar support flange portions carried by said connecting flange portions and arranged in a parallel facing relationship to said mounting plate portion and to cooperate therewith to define facing mounting channels, a trolley supported by said guide track to move lengthwise thereof, and means for mounting said keyboard on said trolley, the improvement comprising in combination:

said trolley having a first pair of support rollers mounted for rotation about a horizontally extending first axis with one of said support rollers of said first pair disposed in each of said mounting channels, a second pair of support rollers mounted for rotation about a horizontally extending second axis disposed parallel to said first axis with one of said support rollers of said second pair disposed in each of said mounting channels, said first and second pairs of support rollers having oppositely facing surfaces thereof spaced from facing surfaces of said connecting flange portions sufficiently to loosely receive said support rollers therebetween and permit said support rollers to freely move lengthwise of said guide track within said mounting channels for supporting said trolley for movement lengthwise of said guide track from adjacent said front end in which said keyboard is adapted to be disposed in a forward use position towards an opposite end thereof in which said keyboard is adapted to be disposed in a rearward recessed position, and follower means upstanding from said trolley in a direction towards said mounting plate portion and intermediate said oppositely facing surfaces of said support rollers; and a guide member fixed to said mounting plate portion and defining a guide channel disposed essentially parallel to said facing surfaces of said connecting flange portions and having a front end disposed immediately adjacent said front end of said guide track and a rear end, said guide channel slidably engaging with said follower means for constraining said trolley against movement transversely of said guide track when said trolley is disposed adjacent said from end of said guide track, and said guide channel having a length substantially less than the length of said guide track.

2. The improvement accordingly to claim 1 wherein said followers means includes a pair of follower members disposed one intermediate each of said first pair of support rollers and said second pair of support rollers.

3. The improvement according to claim 1, wherein said length of said guide channel is no greater than twice the length of said follower means, as measured normal to said axes.

4. The improvement according to claim 1, wherein said guide member defines a converging inlet for said rear end of said guide channel.

5. The improvement according to claim 1, wherein there is additionally provided a cover plate for blocking said front end of said guide channel to prevent movement of said follower means forwardly therethrough.

6. The improvement according to claim 5, wherein said cover plate extends sidewise between said connecting flange portions and vertically between said mounting plate portion and said support flange portions.

7. The improvement accordingly to claim 5, wherein said cover plate has a mid-portion engaging with said guide member for locating said cover plate sideways between said connecting flange portions and is removably fixed to said mounting plate portion.

8. The improvement according to claim 1, wherein said follower means includes a pair of follower members disposed one intermediate each of said first pair of support rollers and said second pair of support rollers, the length of said guide channel is no greater than twice the distance between oppositely facing surfaces of said follower members, and said guide member defines a converging inlet for said rear end of said guide channel.

9. The improvement according to claim 8, wherein there is additionally provided a cover plate for blocking said front end of said guide channel to prevent movement of said follower members forwardly therethrough, said cover plate has a mid-portion engaging with said guide member for locating said cover plate sideways between said connecting flange portions, and said cover plate is removably fixed to said mounting plate portion.

10. The improvement according to claim 1, wherein said guide member is provided with upstanding studs against to be slidably inserted within locating openings formed in said mounting plate portion for locating said guide channel essentially parallel to said connecting flange portions; and there is additionally provided a cover plate for blocking said front end of said guide channel to prevent movement of said follower members forwardly therethrough, said cover plate has a recess for receiving said front end of said guide member thereby to position said cover plate sidewise between said connecting flange portions, and said cover plate is removably fixed to said mounting plate portion, thereby to position said cover member to extend vertically between said mounting plate portion and said support flange portions.

11. The improvement according to claim 10, wherein said follower means includes a pair of follower pins disposed one intermediate each of said first pair of rollers and said second pair of rollers; and said guide channel has a length exceeding the spacing between oppositely facing surfaces of said follower pins.

* * * * *